United States Patent [19]

Prost-Tournier et al.

[11] 4,307,136

[45] Dec. 22, 1981

[54] PROCESS FOR THE CHEMICAL DEPOSITION OF GOLD BY AUTOCATALYTIC REDUCTION

[75] Inventors: Patrick Prost-Tournier, Epagny; Christiane Allemmoz, Loisin, both of France

[73] Assignee: Engelhard Minerals & Chemicals Corp., Iselin, N.J.

[21] Appl. No.: 94,067

[22] Filed: Nov. 14, 1979

[30] Foreign Application Priority Data

Nov. 16, 1978 [FR] France ..... 78 32875

[51] Int. Cl.[3] ..... C23C 3/02

[52] U.S. Cl. ..... 427/443.1; 106/1.23; 427/437

[58] Field of Search ..... 106/1.23, 1.26; 427/443.1, 437, 125, 98

[56] References Cited

U.S. PATENT DOCUMENTS

| | | | |
|---|---|---|---|
| 3,468,676 | 9/1969 | Schneble et al. | 427/437 |
| 3,589,916 | 6/1971 | McCormack | 427/437 |
| 3,917,885 | 11/1975 | Baker | 106/1.26 |
| 4,005,229 | 1/1977 | Miller et al. | 106/1.23 |
| 4,019,128 | 5/1978 | Franz et al. | 106/1.26 |

FOREIGN PATENT DOCUMENTS

| | | | |
|---|---|---|---|
| 1925648 | 11/1970 | Fed. Rep. of Germany | 427/437 |

OTHER PUBLICATIONS

Weiner et al., Method of Stabilizing Electroless Plating Baths, RCA Technical Notes TN No. 941, 12-6-73, 3 pp.

*Primary Examiner*—Ralph S. Kendall

[57] ABSTRACT

An improvement is disclosed for the nonelectrolytic deposition of gold by autocatalytic chemical reduction of a deposition bath containing a soluble gold salt in a strongly alkaline medium by initially adding to the deposition bath an effective amount of a metal from Group III, IV or V of the periodic classification of elements in the form of a soluble salt.

8 Claims, No Drawings

PROCESS FOR THE CHEMICAL DEPOSITION OF GOLD BY AUTOCATALYTIC REDUCTION

FIELD OF THE INVENTION

This invention relates to an improved process for the chemical deposition of gold by autocatalytic reduction of soluble gold salts.

BACKGROUND OF THE INVENTION

The deposition of gold by nonelectrolytic methods is well known. Generally such methods concern autocatalytic reduction of gold salts soluble in an alkaline medium. The reduction is carried out in the presence of a stabilizing agent in order to avoid a spontaneous liberation of the gold at ambient temperature.

Recently the utilization of baths has been proposed which contain an additional soluble salt such as potassium cyanate and an alkali metal borohydride or dimethylaminoborane as a reducing agent. The autocatalytic reduction is carried out in a medium rendered strongly alkaline by sodium or potassium hydroxide and potassium cyanate as stabilizing agents in the decomposition of of the soluble gold salts.

OBJECT OF THE INVENTION

It is the object of the invention to provide a bath for the chemical deposition of gold by autocatalytic reduction of soluble gold salts wherein the bath has maximum stability.

It is also an object of the invention to provide a bath for the chemical decomposition of gold by autocatalytic reduction of soluble gold salts wherein the bath has maximum stability.

It is also an object of the invention to provide a bath for the chemical decomposition of gold by autocatalytic reduction wherein a maximum amount of gold is deposited in a minimum of time.

SUMMARY OF THE INVENTION

These objects are obtained according to the present invention by the addition to the gold baths of the type described hereinabove of very small quantities of metals belonging to Groups III, IV and V of the periodic classification of the elements. See the front inside cover of *Chemistry Principles and Properties,* Sienko and Plane, McGraw-Hill (New York 1966) for the periodic chart of the elements. The addition of such quantities of such metals facilitates the deposition of the gold from the bath.

The invention provides a bath for the chemical deposition of gold by autocatalytic reduction of soluble gold salts in a strongly alkaline medium. The gold baths contain a small quantity of a metal from Groups III, IV or V of the periodic table. Especially suitable metals from these groups include aluminum, gallium, indium, thallium, germanium, tin, lead, arsenic, antimony and bismuth.

The quantity of metal present in the bath from Groups III, IV or V is in the form of soluble salts and is preferably present in an amount between 0.05 mg/l and lg/l. Such a quantity of metals in the form of salts is introduced into the chemical bath containing between 0.1 and 20 g/l and preferably between 1 and 10 g/l of soluble gold salts stabilized by a sufficient amount of alkali metal cyanate whose concentration varies between 0.1 and 50 g/l.

We have determined that in order to obtain the best results it is very important to maintain the pH of the bath of gold solution at a level of at least 10. Such a level of alkalinity appears to be necessary in order to obtain a good reduction of the soluble gold salts.

It is known for example, that an aqueous solution of borohydride reducing agent is unstable at ambient temperature because of the following two-step reaction:

$$BH_4^- + H_2O \rightarrow BH_3OH^- + H_2$$

$$\text{and } BH_3OH^- + H_2O \rightarrow BO_2^- + 3H_2$$

and that it is necessary in order to minimize the loss of $BH_4^-$ to introduce into the bath a sufficient quantity of alkaline hydroxide. It is also known, on the other hand, that a too elevated alkaline hydroxyl concentration exerts a harmful effect on the amount of the gold deposited which varies inversely to the concentration of the alkaline hydroxide.

It is also known that the presence of a buffering agent permits maintaining equilibrium between $BH_4^-$ and $BH_3OH^-$, the latter constituting the actual reducing agent for the $Au(CN)_2^-$ according to the reaction:

$$BH_3OH^- + 3Au(CN)_2^- + 3OH^- \rightarrow BO_2^- + 3/2H_2 + 2H_2O + 3Au + 6CN$$

In the case where the reducing agent used is dimethylaminoborane (DMAB), these compounds are equivalent reducing agents to the borohydride because of the following reaction:

$$(CH_3)_2NHBH_3 + OH^- \rightarrow (CH_3)_2NH + BH_3OH^-$$

The increase in the concentration of hydroxide ion in the DMAB-containing bath results in an increase in the amount of gold deposited.

In order to keep the bath of gold solution at such an elevated pH so that plenty of free hydroxide ion is available, it is advantageous to add a buffer to the gold bath. Such buffering compounds and salts are well-known to those skilled in the art. The salts include phosphates or pyrophosphates, carbonates, borates, acetates, citrates, sulfates or thiosulfates, thiocyanates or tartrates, alone or in combination with the corresponding free acid or base. The pH of such a gold deposition bath should be maintained at a pH of about 12, where the reducing agent is a borohydride and in the area of 13 where the reducing agent is dimethylaminoborane.

It has also been determined that it is advantageous to add complexing agents and/or stabilizing agents to the gold deposition bath. The complexing agents must have the ability to form a complex with the Group III, IV or V metal added to the bath in the form of salts. The stabilizing agents likewise must have the ability to stabilize the salts containing the Group III, IV or V metals. The addition of complexing agents or stabilizing agents to the baths permits an increase in the amount of the Group III, IV or V metal that can be added to the bath without forming an undesirable precipitate in the bath thereby preventing the gold from undergoing reduction. Instead the complexing agents and/or stabilizing agents facilitate the deposition of gold from the bath solution to such an extent that the bath becomes exhausted from removal of substantially all of the gold.

According to a preferred feature of the invention the complexing agents are chosen from among the sodium salts of tri-, tetra- and pentacetic acids. Especially preferable are the sodium salts of nitrilotriacetic acid (NTA), 2-hydroxyethylenediaminotetracetic acid (HEDTA), 1,2-diaminocyclohexanetetracetic acid (DCTA), ethylenediaminetetracetic acid (EDTA), ethyleneglycol-bis-(2-amino-ethyl ether-tetracetic acid (EGTA); and diethylenetetramine-pentacetic acid (DTPA).

According to another feature of the invention, the stabilizing agents are chosen from among the carbohydrates and their derivatives especially the aldehyde-polyols (aldoses) or ketone-polyols (ketoses), or from among the gluconates or saccharides.

Other stabilizing agents that can be used are diketones. The preferred diketone is acetylacetone. Additional stabilizing agents that may be employed include the polyamines. The preferred polyamines include ethylene-dimaine, triethylene-tetramine, hexamethylene-tetramine or tetra-ethylene-pentamine. Still other stabilizing agents that may be employed include the glycols. The preferred glycol is ethylene glyxol.

In the case where a complexing agent and/or stabilizing agent is added to the deposition bath, the quantities of Group III, IV of V metals should be between 0.1 mg/l and 5 g/l. The amount of the complexing agent and/or stabilizing agent added to the bath according to the invention should vary in accordance with the concentration of the Group III, IV or V metals therein. The concentrations of the complexing and/or stabilizing agents are usually between 0.1 and 100 g/l and preferably between 0.1 and 10 g/l.

The following nonlimiting examples give an indication of the invention and show its importance over the art.

In each of the examples hereafter the tests have been carried out on brass cells placed in a 250 ml beaker; the temperature of the baths was determined to a point ±1° C.

The products are of the quality "pure for analysis".

EXAMPLE 1

A cell of 100 $cm^2$ made of brass is placed in a bath at 73° C. and contains:

Gold (in the form of $KAu(CN)_2$): 2 g/l
KCN: 10 g/l
$NaBH_4$: 3 g/l
KOH: 2 g/l

The bath is maintained for 20 minutes under moderate agitation and 0.2 microns of gold are deposited.

To the bath mentioned above is added 2 mg/l of lead (in the form of lead acetate). The bath loses its stability and a precipitate forms within 7 minutes.

The same procedures and reaction conditions are employed above except that the lead (in the form of lead acetate) is added initially to the bath in a concentration of 9.05 mg/l. The bath maintains good stability and after about 20 minutes, 0.65 microns of gold are deposited.

EXAMPLE 2

A cell of 50 $cm^2$ is placed in a bath of a gold solution according to the invention and has the following composition:

Gold (in the form of $KAu(CN)_2$): 3 g/l
KCN: 2 g/l
$NaBH_4$: 3 g/l
$Na_3PO_4$ (buffer): 5 g/l
NaOH: 8 g/l
Acetic Acid: 0.5 g/l
Antimony (in the form of the ditartrate): 1 mg/l
pH=12

After agitation for 30 minutes 1.2 microns of gold were deposited.

EXAMPLE 3

A cell of 20 $cm^2$ is placed in a bath of a gold solution according to the invention at 70° C. with the following composition:

Gold (in the form of $KAu(CN)_2$): 1 g/l
KCN: 0.2 g/l
Dimethylaminobutane (DMAB): 0.5 g/l
$H_2BO_3$: 50 g/l
NaOH: 24 g/l
Aluminum (in the form of $Al_2O_3$): 0.1 g/l
HMTA: 0.2 g/l
pH=13

After agitation for 1 hour, 1.1 microns of gold are deposited.

EXAMPLE 4

A cell of 20 cm is placed in a bath at 90° C. having the following composition:

Gold (in the form of $KAu(CN)_2$): 1 g/l
KCN: 0.5 g/l
DMAB: 2 g/l
$Na_3PO_4$ (buffer): 5 g/l
KOH: 7 g/l
Indium (in the form of nitrate): 8 mg/l
EDTA (disodium salt): 0.5 g/l
pH=13

After 1 hour of gentle agitation, 2.1 microns of gold were deposited.

EXAMPLE 5

A cell of 50 $cm^2$ is placed in a bath of gold at 80° C. having the following composition:

Gold (in the form of $KAu(CN)_2$): 2 g/l
KCN: 0.2 g/l
DMAB: 0.5 g/l
$H_3BO_3$: 5 g/l
NaOH: 24 g/l
thallium (in the form of sulfate): 2 mg/l
ethylenediamine: 0.5 g/l
pH=13

The bath is maintained without agitation. After 90 minutes the cell is withdrawn from the bath and weighed. The bath is then cooled to 50° C. and the following are added:

AuCN: 1.13 mg
DMAB: 0.5 mg
thallium (in the form of sulfate): $5\times10^{-4}$ mg The rate of deposition for the gold bath then becomes 2.1 microns per hour.

After about 18 hours of work, the rate is only 1.6 microns/hours and drops off progressively.

EXAMPLE 6

A cell of 50 $cm^2$ is placed in a gold bath at 70° C. having the following composition:

Gold (in the form of $KAu(CN)_2$): 2 g/l
KCN: 2 g/l
$KBH_4$: 2 g/l
$K_2HPO_4$: 10 g/l
KOH: 6 g/l
Lead (in the form of acetate): 1 mg/l
triethanolamine: 1 cc/l
pH=13

After 20 minutes of vigorous agitation, 1 micron of gold is deposited.

EXAMPLE 7

A cell of 100 $cm^2$ is placed in a gold bath at 70° C. having the following composition:

gold (in the form of $KAu(CN)_2$): 2 g/l
KCN: 3 g/l
$NaBH_4$: 2.5 g/l
$Na_3PO_4$ (buffer): 4 g/l
Arsenic (in the form of $As_2O_3$): 0.2 mg/l
fructose: 0.15 g/l
NaOH: 2 g/l
pH = 12.2

The bath is maintained under moderate agitation.

At the end of 20 minutes, 1.1 microns of gold are deposited. At the end of 40 minutes, 2.5 microns of gold are deposited.

In about 1 hour, the bath is about 95% spent and 2.5 microns of gold are deposited.

EXAMPLE 8

A cell of 100 $cm^2$ is placed in a bath of gold at 70° C. having the following composition:

gold (in the form of $KAu(CN)_2$): 3 g/l
$NaBH_4$: 3 g/l
KCN: 2 g/l
KOH: 1 g/l
thallium (in the form of sulfate): 0.2 mg/l
sodium gluconate: 6 g/l
pH = 12

The operation is carried out under strong agitation.

At the end of 45 minutes, 2.8 microns of gold are deposited.

At the end of 60 minutes, 3.7 microns of gold are deposited and the gold bath is 97% spent.

What is claimed is:

1. In a process for the nonelectrolytic deposition of gold by autocatalytic chemical reduction of a deposition bath containing a soluble gold salt in a strongly alkaline medium; the improvement which comprises adding to said bath a metal selected from the group consisting of aluminum, gallium, indium, thallium, germanium, tin, lead, arsenic, antimony and bismuth in the form of a soluble salt and at essentially the same time as said gold salt, in an amount effective to increase the deposition of gold and maintain bath stability.

2. The improvement defined in claim 1 wherein the metal from Group III, IV or V is aluminum, gallium, indium, thallium, germanium, tin, arsenic, antimony or bismuth.

3. The improvement defined in claim 1 wherein the deposition bath contains a soluble gold salt in a concentration of between 0.1 and 20 g/liter and is stabilized by an alkali metal cyanate varying in concentration between 0.1 and 50 g/liter.

4. The improvement defined in claim 1 wherein the quantity of the metal present lies between 0.05 mg and 1 g/liter.

5. The improvement defined in claim 1 wherein the quantity of the metal present lies between 0.1 mg. and 5 g/liter.

6. The improvement defined in claim 1 further comprising the step of adding a buffer so that the pH of the bath is maintained at a level of at least 10.

7. The improvement defined in claim 1 further comprising the step of adding a complexing agent suitable for formation of a complex with said metal.

8. The improvement defined in claim 7 wherein the complexing agent is a sodium salt of a tri-, tetra- or pentacetic acid.

* * * * *